US007490633B2

(12) United States Patent
Bouchet et al.

(10) Patent No.: US 7,490,633 B2
(45) Date of Patent: Feb. 17, 2009

(54) SHED-FORMING MECHANISM, A LOOM FITTED WITH SUCH A MECHANISM, AND A METHOD OF SELECTING MOVING HOOKS IN SUCH A MECHANISM

(75) Inventors: Damien Bouchet, Chaponnay (FR); Alexis Porte, Tignieu (FR)

(73) Assignee: Staubli Lyon, Chassieu (FR)

( * ) Notice: Subject to any disclaimer, the term of this patent is extended or adjusted under 35 U.S.C. 154(b) by 0 days.

(21) Appl. No.: 11/797,410

(22) Filed: May 3, 2007

(65) Prior Publication Data

US 2007/0267083 A1 Nov. 22, 2007

(30) Foreign Application Priority Data

May 3, 2006 (FR) ..... 06 03942

(51) Int. Cl.

| | |
|---|---|
| ***D03C 3/00*** | (2006.01) |
| ***D03C 3/30*** | (2006.01) |
| ***D03C 3/36*** | (2006.01) |
| *D03C 13/00* | (2006.01) |
| *D03D 49/00* | (2006.01) |

(52) U.S. Cl. ..... 139/59; 139/65; 139/55.1; 139/317

(58) Field of Classification Search ..... None
See application file for complete search history.

(56) References Cited

U.S. PATENT DOCUMENTS

| | | | | |
|---|---|---|---|---|
| 3,747,647 | A * | 7/1973 | Bergmann | 139/59 |
| 3,967,652 | A * | 7/1976 | Seiler | 139/59 |
| 4,702,286 | A * | 10/1987 | Palau et al. | 139/455 |
| 5,038,837 | A * | 8/1991 | Palau et al. | 139/65 |
| 5,116,364 | A * | 5/1992 | Bassi et al. | 139/65 |
| 5,133,389 | A * | 7/1992 | Griffith | 139/455 |
| 5,257,649 | A * | 11/1993 | Froment | 139/59 |
| 5,435,353 | A * | 7/1995 | Bourgeaux | 139/59 |
| 5,636,663 | A * | 6/1997 | Lacroix | 139/86 |
| 5,743,308 | A * | 4/1998 | Bassi et al. | 139/455 |
| 5,839,481 | A * | 11/1998 | Bassi et al. | 139/455 |

(Continued)

FOREIGN PATENT DOCUMENTS

| | | |
|---|---|---|
| EP | 0823501 | 2/1998 |

(Continued)

*Primary Examiner*—Bobby H Muromoto, Jr.
(74) *Attorney, Agent, or Firm*—Dowell & Dowell PC

(57) ABSTRACT

In this mechanism (7) a moving hook comprises a body (20) provided with a nose (202) for bearing against a corresponding knife (14), and a flexible blade (21) secured to the body so as to be capable of moving relative thereto and designed to interact with a retaining lever (16) belonging to the selector device. The selector lever (16) forms a ramp (313) over which a portion (214) of the resilient blade (21) slides when the hook (13) is moved in the vicinity of its top dead-center position. The ramp on which the selector lever slides is shaped in such a manner that the component ($F_A$+$F_B$+$F_C$) parallel to the travel direction (X-X') of the moving hook (13) of the resultant of the forces ($R_A$, $R_B$, $R_C$) acting on the flexible blade (21) when in contact with the ramp (313) in the vicinity of the top dead-center point of its travel and at the beginning of its downward movement ($F_{14}$), is directed downwards.

9 Claims, 4 Drawing Sheets

U.S. PATENT DOCUMENTS

| | | | | |
|---|---|---|---|---|
| 5,881,777 | A * | 3/1999 | Bassi et al. | 139/455 |
| 5,996,648 | A * | 12/1999 | Himmelstoss | 139/455 |
| 6,302,154 | B1 * | 10/2001 | Bassi et al. | 139/85 |
| 7,017,618 | B2 * | 3/2006 | Bassi et al. | 139/59 |
| 2004/0079433 | A1 * | 4/2004 | Bassi et al. | 139/55.1 |

FOREIGN PATENT DOCUMENTS

| | | | |
|---|---|---|---|
| EP | 1413657 | | 4/2004 |
| FR | 2715666 | | 8/1995 |
| FR | 2756574 | | 6/1998 |
| JP | 2004143660 | A * | 5/2004 |

* cited by examiner

SHED-FORMING MECHANISM, A LOOM FITTED WITH SUCH A MECHANISM, AND A METHOD OF SELECTING MOVING HOOKS IN SUCH A MECHANISM

BACKGROUND OF THE INVENTION

1. Field of the Invention

The invention relates to a shed-forming mechanism and to a loom fitted with such a mechanism. The invention also relates to a method of selecting moving hooks of such a mechanism.

2. Description of Related Art

In a Jacquard type loom, a shed-forming mechanism selectively raises heddles, each having an eyelet passing a warp yarn, the yarn being situated as a function of the position of a hook secured to the top end of the heddle, either above or below a weft thread moved by the loom. Such a mechanism, as described for example in U.S. Pat. No. 7,017,618, includes moving hooks each provided with a lateral nose capable of co-operating with knives driven with vertical reciprocating motion in phase opposition. Each moving hook is fitted with a flexible metal blade for interacting with a retaining lever belonging to a selector device, thus generally obtaining satisfaction. Furthermore, a resilient abutment is placed on the path of the moving hooks where they come into the vicinity of the top dead-center point of their travel. According to the technical teaching of U.S. Pat. No. 5,839,481, the moving abutment serves to overcome the friction forces that act on a moving hook when it begins its downward movement, thus making it possible to avoid overdimensioning the return springs of the moving hooks. Such a resilient abutment has the effect of suddenly overloading the shed-forming mechanism when the moving hooks are moved upwards in the vicinity of the top dead-center points of their respective paths. The moving hooks all engage the corresponding abutments at substantially the same time, which abutments are loaded with a prestress compression spring. In addition, the resilient abutment presents a cost that reduces the overall economic performance of a mechanism incorporating such an abutment.

SUMMARY OF THE INVENTION

The present invention seeks more particularly to remedy those drawbacks by proposing a novel shed-forming mechanism in which the travel direction of the moving hooks can easily be reversed in the vicinity of the top dead-center point of their respective paths, without excessively overloading the knife drive means, and at reasonable cost.

To this end, the invention relates to a shed-forming mechanism on a Jacquard type loom, the mechanism comprising moving hooks each moved by a knife between a top dead-center position, in or near which each hook can be held stationary by a selector device, and a bottom dead-center position, each moving hook comprising a body provided with a nose for bearing against the corresponding knife, and a flexible blade secured to the body while being capable of moving relative thereto and being designed to interact with a retaining lever belonging to the selector device, while the selector lever forms a ramp over which a portion of the resilient blade slides when the hook is moved in the vicinity of its top dead-center position. This mechanism is characterized in that the ramp, on which the selector lever slides, is shaped in such a manner that the component parallel to the travel direction of the moving hook of the resultant of the forces acting on the flexible blade, when in contact with the ramp in the vicinity of the top dead-center point of its travel and at the beginning of its downward movement, is directed downwards.

In the meaning of the present invention, the bottom of the mechanism corresponds to the side of the mechanism facing the shed when the mechanism is installed above the loom, in the normal operating configuration. The top of the mechanism is defined as being opposite from the bottom of the mechanism. Furthermore, the top portion of the mechanism is disposed above a bottom portion of the mechanism, i.e. on the side of the bottom portion that is opposite from the side at which the shed of the loom is located when the mechanism is installed with a normal configuration.

By means of the invention, the ramp on which the selector lever slides serves to exert a downward return force on the flexible blade that compensates the friction forces to which the blade is subjected, thus making it possible to omit a resilient abutment of the type disclosed in EP-0 823 501.

According to aspects of the invention that are advantageous but not essential, such a mechanism may incorporate one or more of the following characteristics:

- the ramp extends in a mean direction that makes an angle relative to the travel direction of the hook that lies in the range 5° to 15°, and the ramp is provided with corrugations;
- the above-mentioned angle advantageously lies in the range 8° to 15°;
- the ramp is curved, with tangents that form angles relative to the travel direction of the hook lying in the range 5° to 15°, which angles advantageously lie in the range 8 to 12°;
- the ramp is provided with corrugations; and
- the ramp comprises a lower ramp portion in which the mean direction forms a first angle relative to the travel direction of the hook, and an upper ramp portion situated above the lower ramp portion and presenting a mean direction that forms a second angle relative to the travel direction of the hook, the second angle having a value that is greater than the value of the first angle. In practice, the first angle may have a value lying in the range 5° to 12°, while the second angle has a value lying in the range 7° to 15°.

The invention also relates to a loom fitted with a shed-forming mechanism as described above, such a loom being less expensive and being capable of operating at higher speed than previously known looms.

Finally, the invention provides a method of selecting moving hooks in a shed-forming mechanism of the above-described type. The method is characterized in that it consists in using the selector lever to exert an individual force on the resilient blade of each hook, when it is beginning its downward movement, in the vicinity of the top dead-center point of its travel, the individual force having its component parallel to the travel direction of the hook directed downwards with a magnitude that is greater than the magnitude of the friction forces to which the blade is subjected.

BRIEF DESCRIPTION OF THE DRAWINGS

The invention can be better understood and other advantages thereof appear more clearly in the light of the following description of two embodiments of a shed-forming mechanism in accordance with the principle of the invention, given purely by way of example and made with reference to the accompanying drawings, in which.

Figure 1:
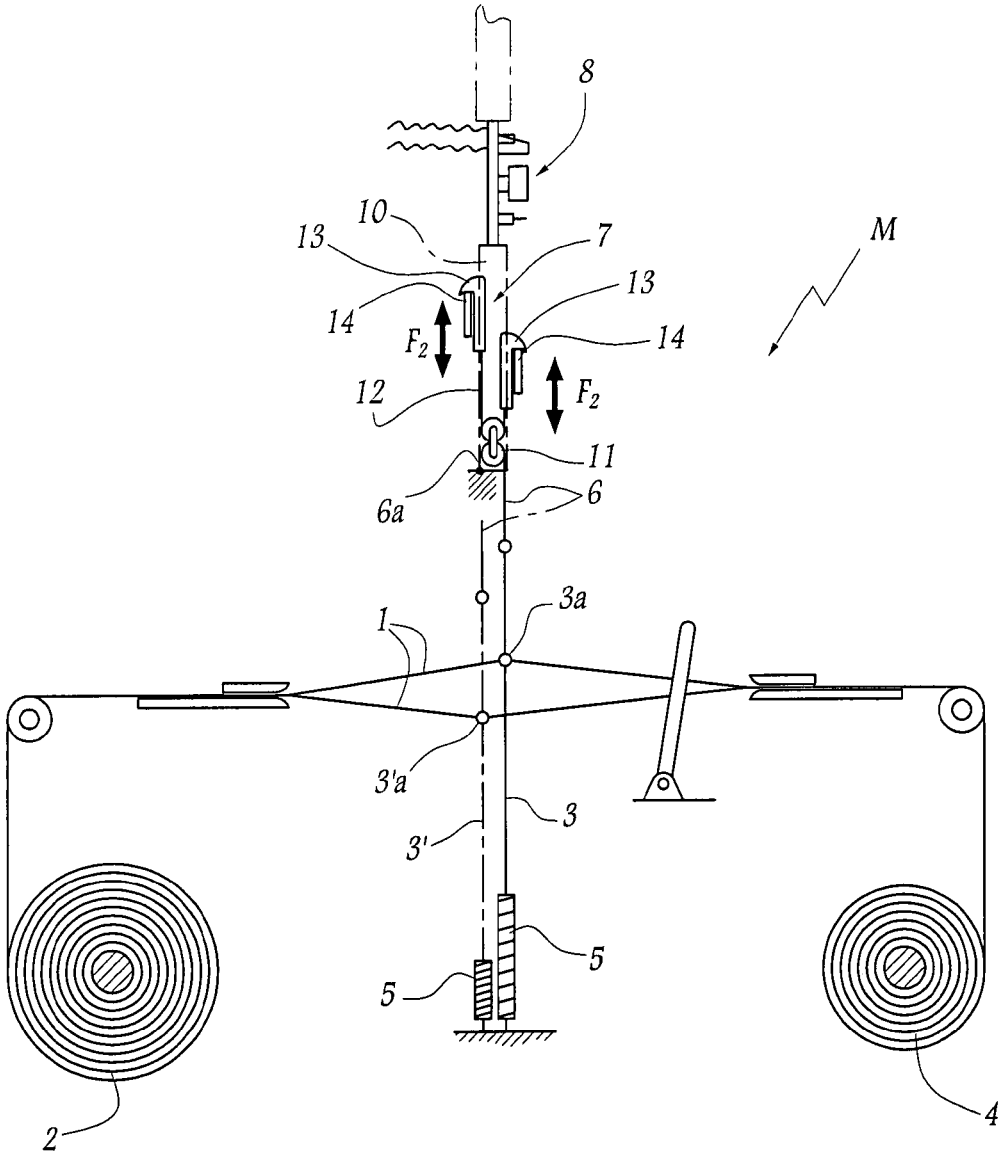
FIG. 1 is a diagrammatic view showing the principle of a Jacquard type loom incorporating the invention.

In the figures, in order to clarify the drawing, forces are not always represented on the same scale.

DETAILED DESCRIPTION OF THE INVENTION

In the loom M shown in FIG. 1, a sheet of warp yarns 1 come from a beam 2. Each warp yarn 1 passes through an eyelet 3*a* in a heddle 3 for opening the way to allow a pick to pass in order to make up the fabric that is wound on a reel 4. Only two heddles 3 and 3' are shown in FIG. 1, the heddle 3 being in a high position while the heddle 3' is in a low position. The bottom end of each heddle is connected to the structure of the loom by a traction spring 5, while its top end is secured to harness 6.

A shed-forming mechanism 7 associated with an electronic control unit 8 serves to raise the harnesses 6 to a greater or lesser extent against a return force exerted by the springs 5. As shown solely for the harness associated with the heddle 3, each harness has one end 6*a* secured to a housing 10 of the mechanism 7, this harness passing through tackle 11 suspended from a cord 12 having its two ends secured respectively to two moving hooks 13 for being raised selectively by knives 14 driven to perform vertical reciprocating motion in phase opposition, as represented by arrows $F_2$.

Only a fraction of the component elements of the shed-forming mechanism is shown in FIG. 1 in order to clarify the drawing.

As can be seen more particularly from FIGS. 2 to 5, each hook 13 is formed by a plastics material body 20 having a bottom end 201 that is molded onto one end 12*a* of the cord 12.

The body 20 forms a single nose 202 extending laterally relative to a main longitudinal axis X-X' of the body 20. The nose 202 is to bear against the top surface 14*a* of a knife or griffe 14. The hook 13 can thus be lifted regularly by a single knife 14.

When bearing against the adjacent knives 14, each hook 13 is moved along its axis X-X'.

The hook 13 also comprises a flexible metal blade 21 partially embedded in the body 20. In practice, the blade 21 has a portion 211 embedded in a zone 203 of the body 20 that is situated close to its bottom end 201, i.e. beneath the portion 204 of the body 20 from which the nose 202 extends laterally.

The portion 211 is downwardly open, thus enabling the end 12*a* of the cord 12 to pass so that it can be embedded in the body 20 over a length $L_{12}$.

The blade 21 extends over a length $L_{21}$ above the portion 211, this length being relatively great compared with the total length $L'_{21}$ of the blade 21.

The blade 21 has two lateral uprights 212 and 2121 that define between them a window 213 in which the major portion of the body 20 is received.

The uprights 212 and 212' extend beyond the window 213 to a curved top end 214 of the blade 21. The uprights 212 and 212' are interconnected by a crossbar 215 that separates the window 213 from an opening 216 formed between the portions 212, 212', 214, and 215 of the blade 21.

Figure 4:
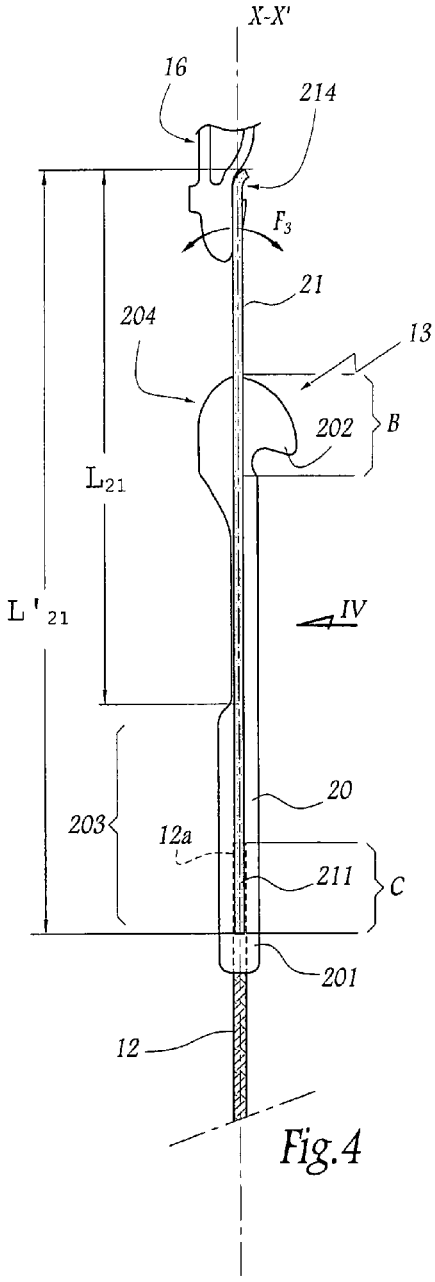
FIG. 4 is a view on a larger scale of a moving hook and a portion of a retaining lever of the FIG. 2 mechanism.

Given their respective fastening techniques, the elements 20 and 21 are secured to the bottom portion of the hook 13, while the portion of the blade 21 that extends over the length $L_{21}$ above the zone 203 of the body 20 is capable of moving laterally, as represented by double-headed arrow $F_3$ in FIG. 4. These lateral movements $F_3$ correspond to relative movements between the blade 21 and the body 20.

The mechanism 7 also has an electromagnet 15 embedded in a portion of the housing 10. The housing 10 has two stationary shafts 10*a* on which two retaining levers 16 are pivotally mounted for co-operating respectively with the two moving hooks 13 that are connected to the two ends of a single cord 12.

Figure 2:
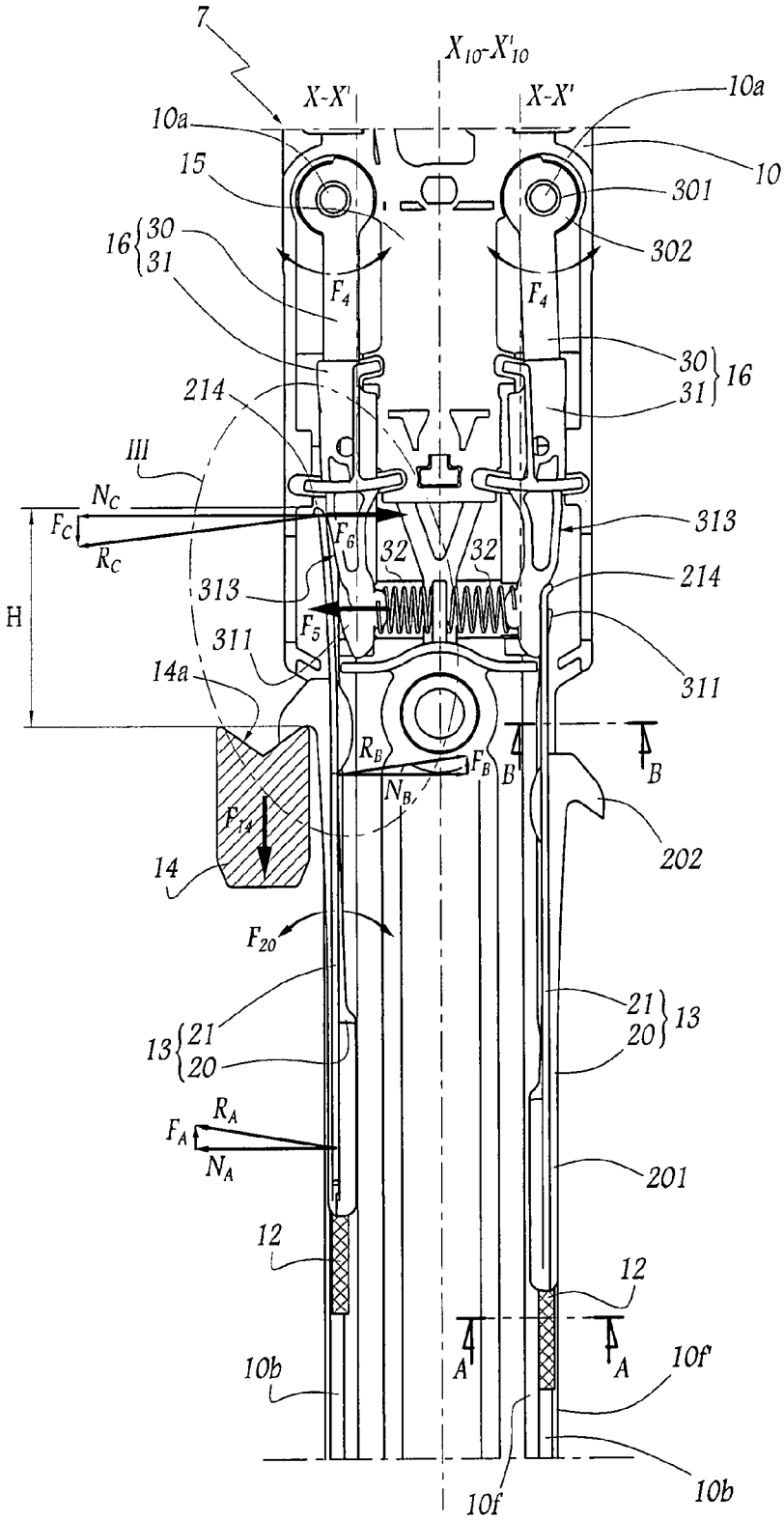
FIG. 2 is a longitudinal section on a larger scale showing the shed-forming mechanism of the FIG. 1 loom.
Figure 2A:
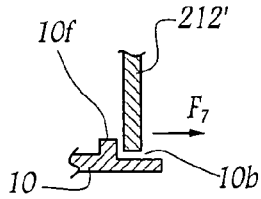
FIGS. 2A and 2B are fragmentary sections respectively on lines A-A and B-B in FIG. 2.

Each lever 16 comprises a metal bar 30 having a vertical hole of circular section 301 matching the outside diameter of a shaft 10*a*, such that the bar 30 can be mounted on the shaft 10*a* with freedom to pivot, as represented by double-headed arrows $F_4$ in FIG. 2. The hole 301 in each bar 30 is formed in an end 302 of the bar.

At its opposite end, the bar 30 is embedded in a body 31 made of non-magnetic material, such as a plastics material. The body 31 forms a nose 311 for retaining a moving hook 13 close to its top dead-center position. The body 31 is also provided with a centering stub 312 for centering relative to a spring 32 exerting a force $F_5$ on the body 31, tending to cause the lever 16 to pivot outwards from the housing 10. This force tends to cause the nose 311 to penetrate into the opening 216 of the blade 21 of an adjacent moving hook, thus enabling such a moving hook to be held in the high position.

The metal bar 30 of a lever 16 serves to control the pivoting thereof by means of the electromagnet 15, it being possible for a lever 16 to be moved by the curved end 214 of a blade 21, and optionally to be held in position against the force $F_5$ when the electromagnet 15 is excited.

Figure 2B:
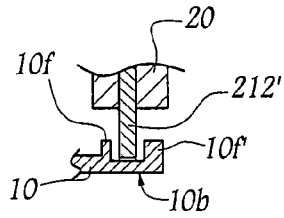

In addition, the uprights 212 and 2121 of the blade 21 of a hook 13 slide in grooves 10*b* formed vertically in the housing 10 and extending parallel to the central axis $X_{10}$-$X'_{10}$ of the housing, as can be seen in FIG. 2 where the cords 12 are shown in part only so as to make the grooves 10*b* visible. Thus, a lever 13 is guided relative to the housing 10 accurately and with minimum wear. As set out in U.S. Pat. No. 7,017,618, each groove 10*b* of the housing 10 is defined by two ribs 10*f* and 10*f'* between which the groove extends, thus enabling the uprights 212 or 212' that it receives to be guided effectively parallel to the axes X-X' and $X_{10}$-$X'_{10}$. Each rib has this shape from the bottom of the housing 10 up to approximately the location of the top rounded portion of the nose 202 on the right-hand side of FIG. 2, where the rib 10*f'* ends, while the rib 10*f* continues upwards. By eliminating the outside edge 10*f'* of the groove, i.e. by leaving the groove open towards the outside of the housing close to the retaining lever 16, the blade 21 is free to move towards the outside in the direction of arrow $F_7$ in FIG. 2B when the blade 21 comes to bear against the adjacent lever 16, as shown on the left-hand side of FIG. 2, in order to exert a leveling force $F_6$.

In practice, the major portion of the flexing of the blade 21 takes place in the portion of the housing 10 where the groove 10*b* does not have an outside edge, this portion extending over a height H between the high position of the nose 202 on the right of FIG. 2 and the zone of interaction between the blade 21 and the lever 16 during leveling.

In a variant of the invention that is not shown, the outer rib 10*f'* that forms the outside edge of the groove 10*b* need not be omitted over the height H, but may instead be spaced apart from the rib 10*f* to as to leave sufficient room for the blade 21 to move.

The curved end 214 of the blade 21 is also dimensioned in such a manner as to come to bear against a ramp 313 formed by the edge of the body 31 of each lever 16 remote from the axis $X_{10}$-$X'_{10}$, and exert a force $F_6$ thereagainst. This transient thrust of a hook 13 against a lever 16 serves to proceed with leveling the lever 16, i.e. bringing it to bear against the electromagnet 15, with resilient preloading because of the flexing of the blade 21 which acts as the resilient tongue described in U.S. Pat. No. 4,702,286. The blade 21 thus performs a leveling function.

When the knife 14 begins its downward travel parallel to the axes X-X' and $X_{10}$-$X'_{10}$, as represented by arrow $F_{14}$ on the left of FIG. 2, the flexible blade 21 is in contact with the housing 10 at the level of the two grooves 10*b* in which the uprights 212 and 212' are engaged. It is also in contact with the ramp 313 of the corresponding lever 16 on which its end 214 slides.

At the beginning of this downward movement, the lever 16 is subjected to a leveling force from the blade 21. The blade is moved parallel to the axis X-X' and is subjected to forces that are considered below as acting via three contact zones. A first contact zone A is situated in the low portion of the blade 21, a portion in which the blade 21 slides in the groove 10*b*. In this zone, the blade 21 is subjected to a reaction force $R_A$ having a component $N_A$ normal to the axis X-X' that is outwardly directed, i.e. away from the axis $X_{10}$-$X'_{10}$. The reaction $R_A$ also has a component $F_A$ parallel to the axis X-X', corresponding to the friction to which the blade 21 is subjected and acting upwards, i.e. in a direction that opposes the movement of the blade 21. If the coefficient of friction between the blade 21 and the groove 10*b* is written $K_A$, then the relationship between the above-specified forces is of the following type:

$$F_A = K_A \times N_A$$

In its middle portion B, the blade 21 rubs against the top portion of the rib 10*f'*, thereby inducing a reaction force $R_B$ having a component $N_B$ normal to the axis X-X' that is oriented towards the axis $X_{10}$-$X'_{10}$, whereas its component $F_B$ parallel to the axis X-X' is oriented upwards. This component $F_B$ corresponds to friction forces; it is proportional to the normal component of the reaction $R_B$ in application of the relationship $$F_B = K_B \times N_B$$

where $K_B$ is the coefficient of friction been the blade 21 and the top portion of the rib 10*f'*.

If the rib 10*f'* is not interrupted, as envisaged in a variant above, then the blade bears against the rib, thus generating a reaction of the same type as the reaction $R_B$. The point of contact B is then situated at the location where the rib 10*f'* extends away from the rib 10*f*.

In the zone C, corresponding to the curved end 214 of the blade 21, the blade 21 is subjected to a reaction $R_C$ normal to the ramp 313 and that can be resolved into a component $N_C$ normal to the axis X-X' and a component $F_C$ parallel to said axis. The reaction $R_C$ corresponds to the sum of two forces $F_{21}$ and $F_{313}$ where:

$F_{21}$ results from the effect of the elastic deformation of the blade 21, this force being substantially proportional to the deformation d of the blade 21 relative to its sliding axis X-X' in its low portion; and $F_{313}$ is the result of the friction effect of the end 214 on the ramp 313.

Thus, the reaction force seen by the blade 21 can be defined as a reaction $R_C$ equal to the sum of the effects of elastic deformation of the blade 21 and of friction between the end 214 and the body 31.

Figure 3:
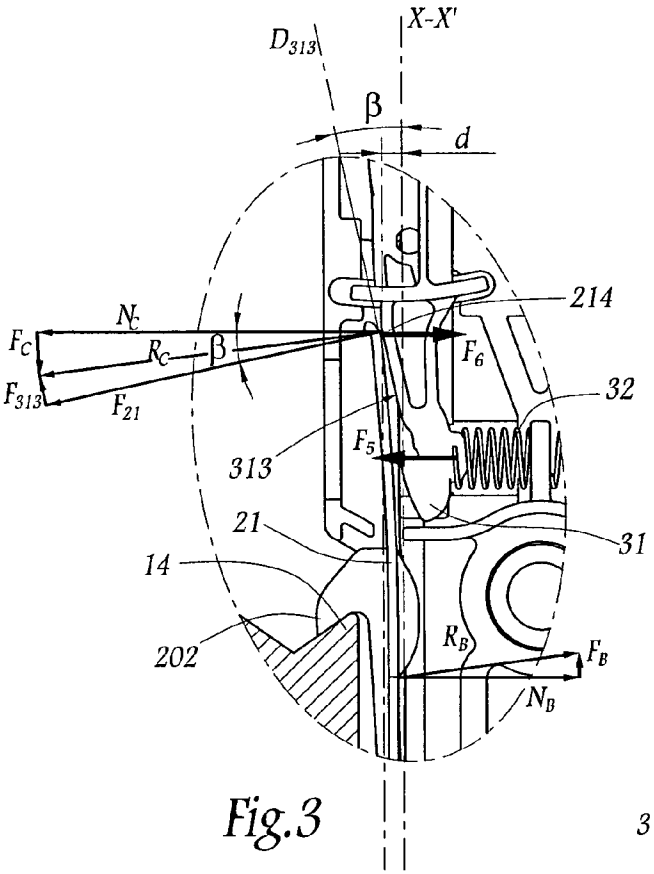
FIG. 3 is a view on a larger scale showing a detail III of FIG. 2.
Figure 5:
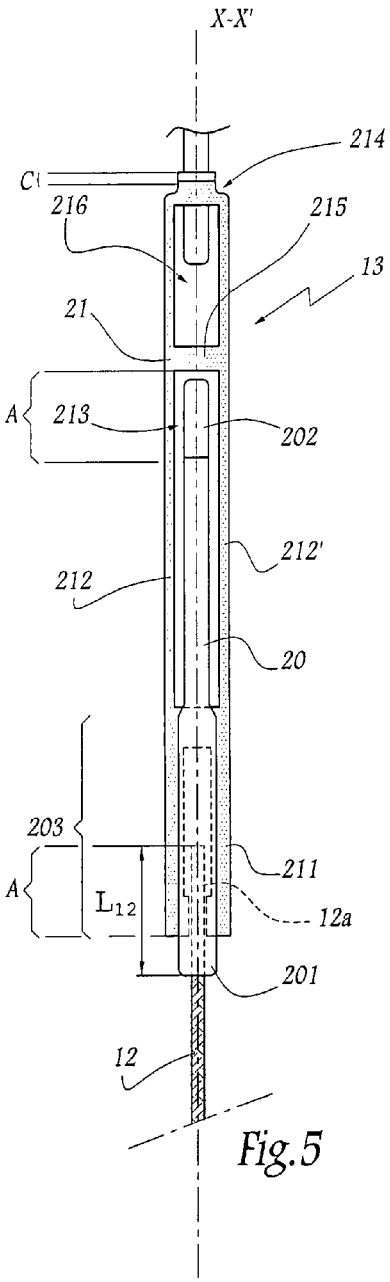
FIG. 5 is a view looking along arrow V of FIG. 4.

A straight line defining the mean direction of the ramp 313 in the plane of FIG. 3 is written $D_{313}$. The angle between the line $D_{313}$ and the axis X-X' is written β.

In practice, the force $F_{313}$ is parallel to the line $D_{313}$.

It can be seen that the force $F_C$ is directed downwards, i.e. towards the shed of the loom fitted with the mechanism 7, and that this component opposes the components $F_A$ and $F_C$ that result from friction between the blade 21 and the housing 10.

By suitably selecting the angle β, the sum of the components $F_A$, $F_B$, and $F_C$ is directed downwards. To achieve this, the magnitude of the force $F_C$ needs to be greater than the sum of the magnitudes of the friction forces $F_A$ and $F_B$.

In practice, this is obtained with a lever 16 having its ramp 313 extending on average along a line $D_{313}$ that forms an angle β relative to the axis X-X' lying in the range 5° to 15°.

A value for the angle β lying in the range 8° to 15°, or even 8° to 12°, enables results to be achieved that are entirely satisfactory insofar as the hook 13 is not braked too suddenly on reaching the top dead-center point of its travel on being raised by a knife 14, while it is sent downwards effectively on the knife 14 beginning its downward movement, the blade 21 then also beginning its downward movement.

Figure 6:
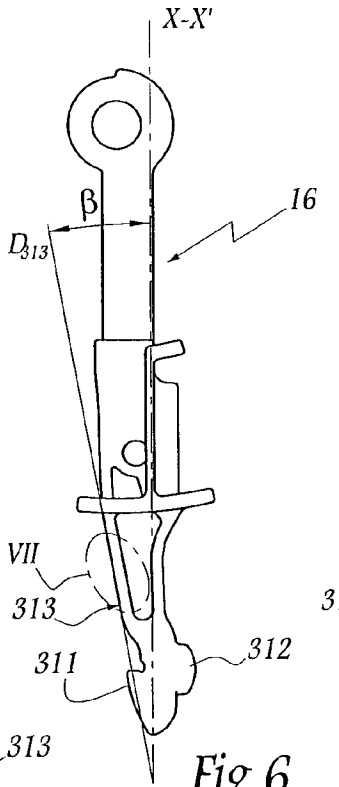
FIG. 6 is a face view of a selector lever of the mechanism of FIGS. 2 to 5.

As shown in FIG. 6, the ramp 313 is generally rectilinear and extends in the direction of the line $D_{313}$.

Figure 7:
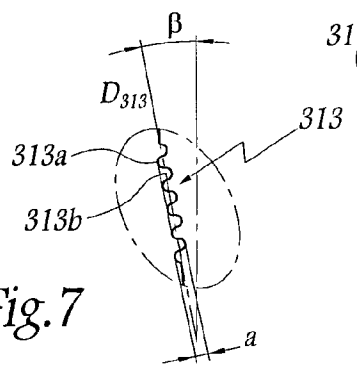
FIG. 7 is a view on a larger scale showing a detail VII of FIG. 6.

According to an aspect of the invention that is shown in FIG. 7 only, the ramp 313 can be provided with corrugations formed by a succession of ridges 313*a* and furrows 313*b* enabling the friction force $F_{313}$ to be decreased by decreasing the coefficient of friction between the ramp 313 and the end 214 of the blade 21. These corrugations serve to retain a lubricant such as a grease or the equivalent on the ramp 313.

According to an aspect of the invention that is not shown, the portion of the nose 311 against which the end 214 of the blade 21 slides may also be provided with such corrugations.

In practice, the corrugations have an amplitude a, corresponding to the distance between the tops of the ridges 313*a* and the bottoms of the furrows 313*b*, that is much less than the dimensions of the body 31. This amplitude may be about 0.2 millimeters (mm).

In a variant of the invention that is not shown, the ramp 313 can be curved. Under such circumstances, the tangents to the ramp 313 are such that each of them is at an angle relative to the axis X-X' lying in the range 5° to 15°, and preferably in the range 8° to 12°.

Figure 8:
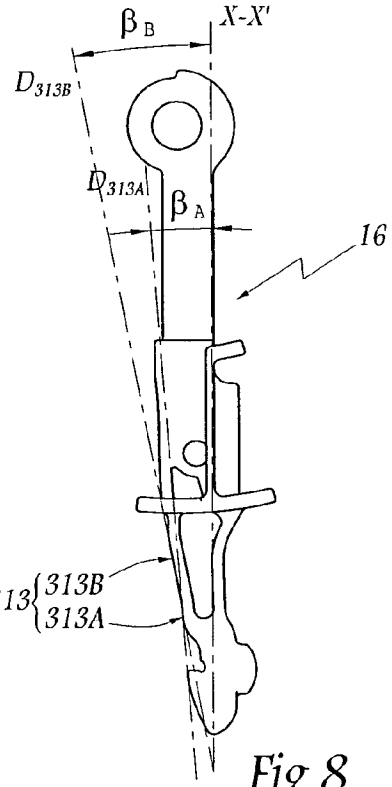
FIG. 8 is a view analogous to FIG. 6 for a mechanism in accordance with a second embodiment of the invention.

As shown in FIG. 8, the ramp 313 may be subdivided into two portions, respectively a bottom portion 313A and a top portion 313B, the portion 313A being closer to the hook 311 than the portion 313B.

Straight lines defining the mean directions of the portions 313A and 313B are written $D_{313A}$ and $D_{313B}$ in FIG. 8. The line $D_{313A}$ forms an angle $\beta_A$ relative to the axis X-X', while the line $D_{313B}$ forms an angle $\beta_B$, greater than the angle $\beta_A$, relative to the same axis. In practice, the angle $\beta_A$ may have a value lying in the range 5° to 12°, while the angle $\beta_B$ has a value lying in the range 7° to 15°.

The configuration of FIG. 8 presents the advantage of generating a downwardly-directed force $F_C$, of a magnitude that is relatively small when the blade engages the ramp 313 via its portion 313A, while the hook 13 is raised by the corresponding knife 14. Docking between the blade 21 and the hook 16 thus takes place progressively instead of suddenly. The orientation of the portion 313B of the ramp 313 serves to exert effectively a return force that is sufficient to overcome the friction forces, of the type of the components $F_A$ and $F_B$, when the hook begins its downward movement bearing on the knife 14, assuming that it is not held in the high position by the nose 311 of the lever 16.

Whatever the embodiment in question, the ramp 313 is shaped in such a manner that the component $F_C$ of the force it exerts on the blade 21 when said blade begins its downward movement is sufficient to overcome the friction forces $F_A$ and $F_B$. In other words, the resultant of the components parallel to the axis X-X' of the forces to which the blade 21 is subjected is then directed downwards, thus making it possible to omit a resilient abutment of the type described in U.S. Pat. No. 5,839,481.

Thus, according to the invention, an individual force $F_C$ is exerted on the blade 21 by virtue of the selector lever 16, which force has its component parallel to the axis X-X' that is greater than the magnitude of the friction forces $F_A$ and $F_B$.

The invention relates to two-position shed-forming mechanisms used in weaving so-called "flat" fabrics, unlike three-position mechanisms used for carpeting and velvets. Nevertheless, the invention can be used in the context of associating two-position mechanisms, thus enabling a three-position or a four-position shed to be obtained, e.g. as described in U.S. Pat. Nos. 5,038,837 or 5,540,262.

The invention claimed is:

1. A shed-forming mechanism on a Jacquard type loom, the mechanism comprising: moving hooks each moved by a knife between a top dead-center position, in or near which each hook can be held stationary by a selector device, and a bottom dead-center position, each moving hook having a body provided with a nose for bearing against the corresponding knife and a flexible blade secured to the body so that the blade is capable of moving relative to the body and capable of interacting with a retaining lever of the selector device, the retaining lever having a first side for engaging a spring and an opposite second side forming a ramp over which a portion of the blade slides when the hook is moved in a vicinity of the top dead-center position, wherein the ramp is provided with corrugations and shaped such that a component ($F_A$+$F_B$+$F_C$) parallel to a travel direction (X-X') of the moving hook of a resultant of forces ($R_A$, $R_B$, $R_C$) acting on the blade when the blade contacts the ramp in the vicinity of the top dead-center position of the hook is directed downwardly.

2. A mechanism according to claim 1, wherein the ramp extends in a mean direction ($D_{313}$) that makes an angle ($\beta$, $\beta_A$, $\beta_B$) relative to the travel direction (X-X') of the hook in the range of 5° to 15°.

3. A mechanism according to claim 2, wherein the angle ($\beta$, $\beta_A$, $\beta_B$) is in the range 8° to 15°.

4. A mechanism according to claim 1, wherein the ramp is curved with tangents that form angles relative to the travel direction of the hook (X-X') in the range of 5° to 15°.

5. A mechanism according to claim 4, wherein the angles between the tangents to the ramp and the travel direction of the hook are in the of range 8° to 12°.

6. A mechanism according to claim 1, wherein the ramp comprises a lower ramp portion having a mean direction ($D_{313A}$) forms a first angle ($\beta_A$) relative to the travel direction (X-X') of the hook and an upper ramp portion situated above the lower ramp portion and having a mean direction ($D_{313B}$) that forms a second angle ($\beta_B$) relative to the travel direction of the hook, the second angle ($\beta_B$) having a value that is greater than the value of the first angle ($\beta_A$).

7. A mechanism according to claim 6, wherein the first angle ($\beta_A$) has a value in the range of 5° to 12°, and the second angle ($\beta_B$) has a value in the range of 7° to 15°.

8. A loom comprising a shed-forming mechanism, the mechanism including moving hooks each moved by a knife between a top dead-center position, in or near which each hook can be held stationary by a selector device, and a bottom dead-center position, each moving hook having a body provided with a nose for bearing against the corresponding knife and a flexible blade secured to the body so that the blade is capable of moving relative to the body and capable of interacting with a retaining lever of the selector device, the retaining lever having a first side for engaging a spring and an opposite second side forming a ramp over which a portion of the blade slides when the hook is moved in a vicinity of the top dead-center position, wherein the ramp is provided with corrugations and shaped such that a component ($F_A$+$F_B$+$F_C$) parallel to a travel direction (X-X') of the moving hook of a resultant of forces ($R_A$, $R_B$, $R_C$) acting on the blade when the blade contacts the ramp in the vicinity of the top dead-center position of the hook is directed downwardly.

9. A method of selecting moving hooks of a shed-forming mechanism on a Jacquard type loom, the mechanism comprising: moving hooks each moved by a knife between a top dead-center position, in or near which each hook can be held stationary by a selector device, and a bottom dead-center position, each moving hook having a body provided with a nose for bearing against the corresponding knife and a flexible blade secured to the body so that the blade is capable of moving relative to the body and capable of interacting with a retaining lever of the selector device, the retaining lever includes a first side for engaging a spring and an opposite second side forming a ramp over which a portion of the blade slides when the hook is moved in a vicinity of the top dead-center position, the ramp having corrugations, wherein the retaining lever exerts an individual force ($R_c$) on the blade of each hook when the hook is in the vicinity of the top dead-center position, the individual force ($R_c$) having a component ($F_c$) parallel to the travel direction (X-X') of the hook directed downwardly with a magnitude that is greater than a magnitude of friction forces ($F_A$, $F_B$) to which the blade is subjected.

* * * * *